US005783907A

United States Patent [19]

Suzuki et al.

[11] Patent Number: 5,783,907

[45] Date of Patent: Jul. 21, 1998

[54] HIGH PRESSURE DISCHARGE LAMPS WITH SEALING MEMBERS

[75] Inventors: Go Suzuki, Nagoya; Norikazu Niimi, Komaki, both of Japan

[73] Assignee: NGK Insulators, Ltd., Japan

[21] Appl. No.: 583,838

[22] Filed: Jan. 11, 1996

[30] Foreign Application Priority Data

Jan. 13, 1995 [JP] Japan ..... 7-003914
Mar. 28, 1995 [JP] Japan ..... 7-069323

[51] Int. Cl.[6] ..... H01J 17/18; H01J 61/36

[52] U.S. Cl. ..... 313/625; 313/634

[58] Field of Search ..... 313/623, 625, 313/626, 634, 624, 638, 639, 640, 641, 493

[56] References Cited

U.S. PATENT DOCUMENTS

| | | | |
|---|---|---|---|
| 4,665,344 | 5/1987 | Kajihara et al. | 313/624 |
| 4,731,561 | 3/1988 | Izumiya et al. | 313/624 |
| 4,742,269 | 5/1988 | Izumiya et al. | 313/624 |
| 4,808,881 | 2/1989 | Kariya et al. | 313/624 |
| 4,825,126 | 4/1989 | Izumiya et al. | 313/623 |
| 4,868,457 | 9/1989 | Strok | 313/625 |
| 4,950,953 | 8/1990 | Ito et al. | 313/624 |
| 4,972,119 | 11/1990 | Kariya et al. | 313/625 |
| 5,352,952 | 10/1994 | Juengst | 313/623 |
| 5,374,872 | 12/1994 | Balaschak et al. | 313/623 |
| 5,404,078 | 4/1995 | Bunk et al. | 313/625 |
| 5,424,608 | 6/1995 | Juengst et al. | 313/623 |
| 5,455,480 | 10/1995 | Bastian et al. | 313/623 |
| 5,592,049 | 1/1997 | Heider et al. | 313/625 |
| 5,661,367 | 8/1997 | Fellows et al. | 313/623 |

FOREIGN PATENT DOCUMENTS

| | | | |
|---|---|---|---|
| 0 080 820 | 6/1983 | European Pat. Off. | H01J 61/28 |
| 0 160 445 | 11/1985 | European Pat. Off. | H01J 61/36 |
| 0 175 502 | 3/1986 | European Pat. Off. | H01J 61/36 |
| 0 181 223 B1 | 5/1986 | European Pat. Off. | H01J 61/36 |
| 0 186 348 B1 | 7/1986 | European Pat. Off. | H01J 61/10 |
| 0 188 229 | 7/1986 | European Pat. Off. | H01J 61/36 |
| 0 262 979 B1 | 4/1988 | European Pat. Off. | H01J 61/36 |
| 0 272 930 B1 | 6/1988 | European Pat. Off. | H01J 61/36 |
| 0 333 455 B1 | 9/1989 | European Pat. Off. | H01J 61/36 |
| 0 335 202 | 10/1989 | European Pat. Off. | H01J 61/36 |
| 0 528 428 | 2/1993 | European Pat. Off. | H01J 61/36 |
| 0 528 428 A1 | 2/1993 | European Pat. Off. | H01J 61/36 |
| 0 609 477 A1 | 8/1994 | European Pat. Off. | H01J 61/36 |
| 0 657 399 A1 | 6/1995 | European Pat. Off. | H01J 61/36 |

*Primary Examiner*—Michael Horabik
*Assistant Examiner*—Michael Day
*Attorney, Agent, or Firm*—Parkhurst & Wendel, L.L.P.

[57] ABSTRACT

A high pressure discharge lamp including: (1) a ceramic discharge tube having an interior space filled with an ionizable light-emitting material and a starting gas, the ceramic discharge tube including a main body and at least one end portion connected to an end of the main body, a corner being formed between an inner surface of the main body and an inner surface of the at least one end portion; (2) a sealing member at least partially fixed inside the at least one end portion, a through-hole being formed through the sealing member; and (3) a current conductor inserted through the through-hole of the sealing member, wherein a storing recess for storing said ionizable light-emitting material as a liquid phase therein is formed at a surface of the sealing member on a side of the interior space.

9 Claims, 10 Drawing Sheets

HIGH PRESSURE DISCHARGE LAMPS WITH SEALING MEMBERS

BACKGROUND OF THE INVENTION (1) Field of the Invention

The present invention relates to a high pressure discharge lamp using a ceramic discharge tube.

(2) Related Art Statement

In the high pressure discharge lamp, opposite end portions of the ceramic discharge tube are closed by inserting a sealing member (ordinarily called "ceramic plug") into each of the opposite end portions of the tube, a through-hole is provided in the sealing member, and a metallic current conductor is inserted into the through-hole. To this metallic current conductor is attached a given electrode, and an ionizable light-emitting material is sealingly filled in an interior space of the ceramic discharge tube. As such a high pressure discharge lamp, a high pressure sodium light-emitting lamp and a metal halide lamp are known. Particularly, the metal halide lamp has excellent coloring property. As the material for the discharge tube, ceramic materials are used so that the discharge tube may be used at high temperatures.

FIG. 9(*a*) is a sectional view for illustrating a preferred end structure of such a ceramic discharge tube. A main body 11 of the ceramic discharge tube has a tubular shape with throttled opposite end portions. The main body 11 is provided with cylindrical end portions 12 at respectively opposite ends. The main body 11 and the end portions 12 are made of, for example, a sintered alumina body. The inner surface 11*a* of the main body 11 is of a curved shape. Since the inner surface 12*a* of the end portion 12 is straight as viewed in an axial direction of the main body, a corner 15 is formed between the main body 11 and the end portion 12. A sealing member 30 is inserted and held inside the end portion 12. A through-hole 30*a* is formed in the sealing member 30, extending in an axial direction. A slender current conductor 5 is fixedly inserted inside the through-hole 30*a*. In this example, the current conductor 5 is of a cylindrical shape, and is to introduce an ionizable light-emitting material into an interior space 13 of the main body 11 through an interior space 5*a* of the current conductor 5. To an outer terminal end of the current-passing conductor 5 is sealingly provided a sealed portion 5*b* after the starting gas and the ionizable material are sealed. The gases are sealed inside the discharge tube by the sealed portions 5*b*. An electrode shaft 7 is joined to the current conductor 5.

In the above discharge tube, the sealing member 30 has a cylindrical hollow contour shape with a flat face 30*b*. It is necessary to effect sealing between the sealing member 30 and the ceramic discharge tube and between the sealing member 30 and the current conductor 5. In a preferred example, the current conductor is inserted into the through hole of the sealing member, an assembly is produced by inserting the sealing member into each of the end portions of the main body, and the assembly is integrally sintered. At that time, a firing shrinkage rate of the sealing member 30 is made smaller than that of the material constituting the ceramic discharge tube, so that the sealing member is intimately and sealingly fitted to the end portions of the discharge tube, whereas the sealing member is sealed to the current conductor through the firing shrinkage of the material of the sealing member 30. Further, a glass layer 14 is usually formed around a portion of the current conductor 5 projecting outside the sealing member 30.

However, having made investigations, the present inventors have discovered that there were the following problems in the above discharge lamp. That is, the metal halide, etc. are sealed inside the interior space 13 of the main body 11. The high pressure discharge lamp is repeatedly turned on and off. Most of the metal halide is distributed inside the interior space 13 of the main body 11 in the form of a gas phase during lightening, whereas a remaining part of the metal halide maintains its liquid phase state. The liquid phase halide may partially flow, in a direction of an arrow A, toward the relatively lower end portion 12. The metal halide used in this lamp under consideration of a light-emitting efficiency exhibits corrosion against the ceramic discharge tube, and particularly against the alumina sintered body, when in the liquid phase. Therefore, as the high pressure discharge lamp is repeatedly turned on and off for a long use time, a portion surrounding the corner portion 15 is corroded, and as shown in FIG. 9(*b*), a corroded face 33 may be formed. When viewed as compared with an original inner face shown by dotted line 31, the corroded face 33 is retracted in a direction of an arrow B. Since the liquid phase metal halide 32 is likely to be stored along the corroded face 33, corrosion is more likely to occur along this corroded face 33. If such corrosion proceeds, it causes the fracture of the high pressure discharge lamp. In view of this, it is necessary to prevent occurrence of the corrosion.

In order to solve the corrosion problem, the present inventors made investigations to suppress the corrosion of the corner portion 15 by positioning the inner surface 34*a* of the sealing member 34 at a location contacting the corner portion 15 as shown in FIG. 10. However, it was revealed that even in this method, the end portion of the inner surface 11*a* of the main body 11 and the inner surface 34*a* of the sealing member 34 tended to be corroded, for example, as shown by a dotted line 36. It was also revealed that a portion near the corner portion 15 of the main body 11 was also corroded so that it might cause the reduction in use life of the high pressure discharge lamp.

SUMMARY OF THE INVENTION

It is an object of the present invention to provide a high pressure discharge lamp, which can prevent corrosion of a ceramic discharge lamp, and particularly the corrosion of an intermediate area between the main body and the end portions thereof so that the service life of the ceramic discharge lamp may be enhanced.

The high voltage pressure lamp according to the present invention comprises a ceramic discharge tube filled with an ionizable light-emitting material and a starting gas in an interior space thereof and having a corner portion between an inner surface of a main body of the ceramic discharge tube and an inner surface of each of end portions thereof; a sealing member at least partially fixed inside each of the opposite end portions of the ceramic discharge tube and provided with a through-hole; and a current conductor inserted into the through-hole of the sealing member, wherein a storing recess is provided at a surface of the sealing member on a side of the interior space of the main body of the ceramic discharge tube, said storing recess being adapted to store a liquid phase of the ionizable light-emitting material.

The present inventors have made investigations on the corrosion problem in the areas between the main body and the end portions of the ceramic discharge tube as mentioned above, but they found it difficult to reduce the corrosion. For this reason, the inventors have made investigations again on the mechanism through which this corrosion proceeded, and discovered that the liquid phase of the remaining metal halide stayed at the end portion, particularly at a portion surrounding the corner portion, which promoted the corrosion there. In view of this, the present inventors have come to consider that the storing recess is preliminarily formed on the surface of the sealing member itself on the side of the interior space so as to store the liquid phase of the ionizable light-emitting material, and the liquid phase of the metal halide is stored in this storing recess of the sealing member.

As a result, it was confirmed that the liquid phase of the metal halide actually resides in the storing recess of the sealing member, such a liquid phase of the metal halide is in turn unlikely to stay in the area between the main body and the end portion of the ceramic discharge tube, and consequently, the corrosion there is largely reduced. However, even if the corrosion of the sealing member proceeds near the storing recess, no adverse effect occurs against the use life of the high pressure discharge lamp despite the corrosion of the sealing member itself because the thickness of the sealing member is large.

These and other objects, features and advantages of the invention will be appreciated upon reading of the following description of the invention when taken in conjunction of the attached drawings, with the understanding that some modifications, variations and changes of the same could be made by the skilled person in the art to which the invention pertains.

BRIEF DESCRIPTION OF THE DRAWINGS

For a better understanding of the invention, reference is made to the attached drawings, wherein.

DETAILED DESCRIPTION OF THE INVENTION

Figure 1:
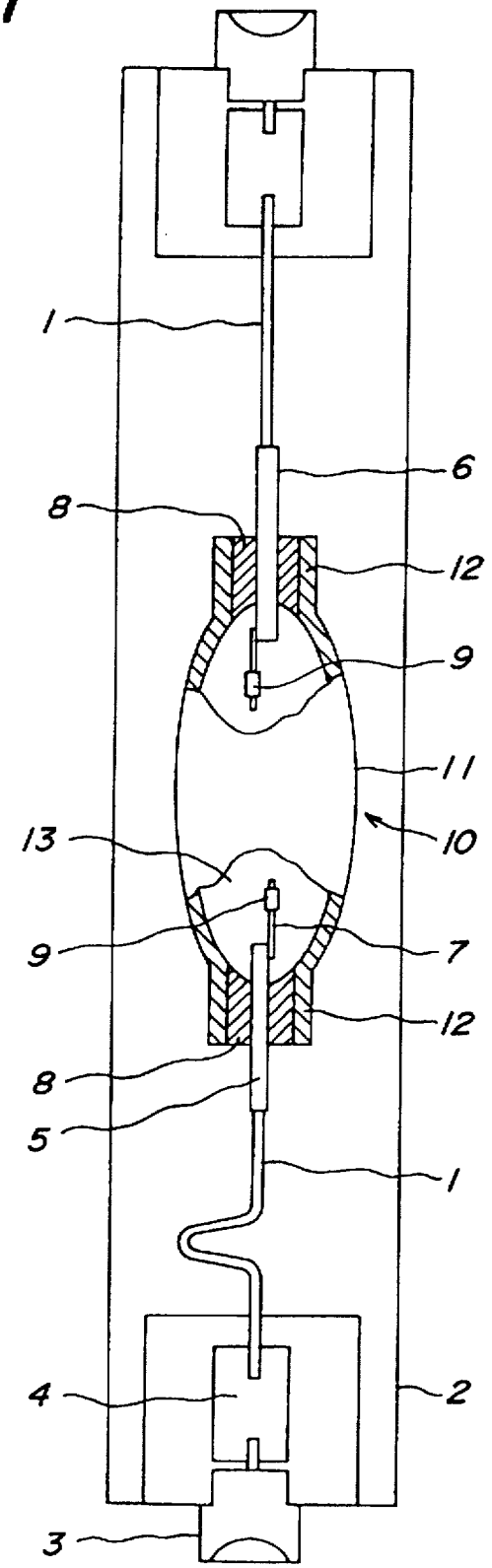
FIG. 1 is a schematic view for schematically illustrating an entire structure of a high pressure discharge lamp according to one embodiment of the present invention.

The present invention will now be explained in detail.

In the present invention, it is preferable to afford an inclination upon the surface of the storing recess. More specifically, it is preferable to form the storing recess such that the thickness of the recessed sealing member as viewed in the central axis direction of the ceramic discharge tube (the thickness of the sealing member as viewed in a direction in which the through-hole extends) decreases as the location laterally goes from the corner portion to the through-hole of the sealing member. By so doing, the depth of the storing recess increases as the location goes from the peripheral edge of the ceramic discharge tube to the center thereof, that is, as the location goes from the peripheral portion to the center of the ceramic discharge tube. By adopting such a configuration, the gas phase of the ionizable light-emitting material flowing from the interior space of the main body is likely to be liquefied and stay at a portion near a central axis of the ceramic discharge tube, that is, a low temperature portion of the light-emitting tube. Therefore, a peripheral portion of the ceramic discharge tube is more unlikely to be corroded.

Furthermore, it is preferable that the inner surface of the main body of the ceramic discharge tube smoothly continues to the storing recess with no step. That is, it is preferable that the corner portion between the main body and the end portion of the ceramic discharge tube is not seen as a step at the inner surface of the ceramic discharge tube. By employing such a combined profile of the main body and the storing recess, the liquid phase of the ionizable light-emitting material flowing along the inner peripheral surface of the main body can be prevented from staying near any step.

In the above case, more specifically, the edge of the sealing member is preferably aligned to be in contact with the corner of the main body so that the corner may not be seen as a step from the outside. In this case, it is preferable that the inner surface of the storing recess of the sealing member is smoothly connected to the inner peripheral surface of the main body.

The present invention may be preferably applied to the high pressure discharge lamp in which any of various kinds of ionizable light-emitting material is sealed. In particular, the present invention is more preferably applied to a metal halide lamp in which a metal halide having a highly corrosive property is sealingly filled. The invention is further preferably applied to the high pressure discharge lamp in which the ceramic discharge tube is made of alumina ceramic.

Furthermore, it is required that the light-emitting efficiency of the high pressure discharge lamp is enhanced by decreasing the weight of the sealing member when the power (watt) of the lamp is small. However, in order to reduce the weight of the sealing member, it is necessary to decrease the volume, i.e., the thickness of the sealing member. As mentioned above, it is necessary to ensure a space for the formation of the storing recess at the sealing member in the high pressure discharge lamp according to the present invention. In addition, since the liquid metal halide staying in the storing recess comes to invade the sealing member from the storing recess in the thickness direction thereof, it is necessary to give an excess thickness to the sealing member.

Therefore, if such an excess thickness is given to the sealing member according to the present invention so that a space may be ensured for the formation of the storing recess at the sealing member and that the liquid metal halide may be prevented from leaking outside due to the above invasion, it is difficult to reduce the thickness of the sealing member as mentioned above.

For this reason, if the dimension of the sealing member is to be reduced particularly in case that the power (watt) is small, it is preferable that the surface of the sealing member on the side of the interior space of the main body is covered with a covering film having resistance against metal halide. By so doing, the liquid metal halide is led to the storing recess formed at the sealing member and invasion of the metal halide into the sealing member can be retarded. Therefore, the necessary thickness from the surface of the storing recess to the outer end surface of the sealing member can be reduced.

As the current conductor, current conductors made of various kinds of high melting point metals or high melting point conductive ceramics may be used. However, from the standpoint of the conductivity, the high melting point metal is preferred. As such a high melting point metal, one or more kinds of metals selected from the group consisting of molybdenum, tungsten, rhenium, niobium, tantalum and their alloys, can be used.

Among the above high melting point metals, the coefficients of thermal expansion of niobium and tantalum substantially match that of the ceramic, particularly the alumina ceramic, constituting the ceramic discharge tube. However, it is known that these metals are likely to be corroded with the metal halide. Therefore, in order to ensure a long use life of the current conductor, it is preferable that the current conductor is made of molybdenum, tungsten, rhenium or an alloy thereof.

However, molybdenum, tungsten, and rhenium generally exhibit smaller coefficients of thermal expansion. For example, the coefficient of thermal expansion of the alumina ceramic is $8\times10^{-6}K^{-1}$, whereas that of molybdenum $6\times10^{-6}K^{-1}$ and that of tungsten and rhenium is less than $6\times10^{-6}K^{-1}$.

As mentioned above, although the coefficient of thermal expansion of the alumina ceramic largely differs from those of the above metals, the current conductor can be gas-tightly kept at the sealing member, as mentioned later, by inserting the current conductor through the through-hole of the molded or calcined sealing member and then integrally firing the resulting assembly as it is. In this case, considerable stress is applied to the current conductor due to the firing shrinkage of the sealing member. Therefore, it is preferable that the current conductor is of a tubular shape. By so doing, as the end portion of the molded body is shrunk during firing, the current conductor is slightly deformed so that the stress due to the shrinkage may be mitigated. From this point of view, it is preferable to set the thickness of the tubular current conductor at not more than 0.25 mm. Since the current conductor is a member which firmly holds the electrode shaft and the electrode, it is preferable to set the thickness of the tubular current corrector at not less than 0.1 mm.

As the material for constituting the sealing member, the same kind as that of the ceramic discharge tube may be used or a material different from that of the ceramic discharge tube may be used. As one example, the sealing member may be formed from the same material as that of the ceramic discharge tube. When the current conductor is made of niobium or tantalum, it is preferable that the sealing member is made of the same kind of a ceramic material as that of the ceramic discharge tube. By so doing, the coefficients of thermal expansion of the current conductor, the ceramic discharge tube and the sealing member can be approximated to one another. In the above, the "same kind" of the materials means that a ceramic is common as a base material, although additional component or components may be different.

On the other hand, when molybdenum, tungsten, rhenium or an alloy thereof is used as the material for the current conductor and the ceramic discharge tube and the sealing member are made of the same kind of the material, for example, alumina ceramic, a gap may be formed between the sealing member and the current conductor due to the difference in thermal expansion as the discharge lamp is used for a long time. Particularly, when the high voltage pressure lamp exhibits excellent color rendering and the maximum cool point is 700° C., relatively large strain occurs in the ceramic material. Consequently, when the turning on/off cycle is repeated at about 500 times, a gap may be formed between the current conductor and the sealing member.

Accordingly, if the coefficient of thermal expansion of the material of the sealing member is between that of the current conductor and that of the material of the end portion of the ceramic discharge tube, it is almost not feared that a gap occurs between the sealing member and the current conductor even in the turning on/off cycle.

In view of the above, it is preferable that the sealing member is composed of a composite material constituted by a first component having a higher coefficient of thermal expansion and a second one having a lower coefficient of thermal expansion. The first component of the composite material is preferably the same ceramic as that of the ceramic discharge tube. By so doing, the ceramic discharge tube and the sealing member can be simultaneously fired. From this point of view, it is preferable that the ceramic discharge tube and the sealing member are both made of the alumina ceramic.

As the second component, selection is made from the group consisting of high melting point metals having corrosion resistance against the metal halide, such as tungsten, molybdenum, rhenium, etc. and ceramics having lower coefficients of thermal expansion, such as aluminum nitride, silicon nitride, titanium carbide, silicon carbide, zirconium carbide, titanium diboride, zirconium diboride, etc. By so doing, high corrosion resistance against the metal halide can be afforded upon the metal halide.

In this case, it is preferable that the rate of the first component such as the alumina ceramic is 60 wt % to 90 wt %, whereas that of the second component is 40 wt % to 10 wt %. The reason why the alumina ceramic is preferred as the first component is that alumina has high corrosion resistance. Further, if the alumina component is incorporated into the composite material, a seam between the end portion of the ceramic discharge tube and the sealing member disappears through the solid diffusion reaction during the firing ordinarily at about 1,800° C. or more, so that the joined portion has a substantially integrated structure.

The above end structure of the ceramic discharge tube can be formed, for example, by the following method. First, a green ceramic discharge tube is formed by a blowing process in which a cylindrical molding having a swelled central portion is extruded from a ceramic material such as powdery alumina, while air is being fed into a molding, and drying and dewaxing the molding. On the other hand, a raw material for the sealing member is measured, and water, alcohol, organic binder, etc. are added to the raw material. The mixture is granulated by using a spray dryer or the like, thereby obtaining a molding granular powder. A green molded sealing member with a through-hole is produced by press molding the resulting powder.

Then, a current conductor is inserted through the through-hole of the molded sealing member, and the resulting assembly is calcined to scatter the molding aid, etc. Thereby, a calcined body is obtained. Alternatively, a calcined body is produced by scattering the molding aid, etc. from the molded body through calcining, and then the current conductor is inserted through the through-hole of the calcined body. In such a calcining step, tungsten oxide, molybdenum oxide or the like mixed as a second component for the sealing member is reduced when the molded body is heated at 1300° to 1600° C. in a reducing atmosphere.

Next, the calcined body for the sealing member is inserted inside the end portion of the calcined body for the ceramic discharge tube, and the calcined bodies for the ceramic discharge tube and the sealing member are integrally fired. By so doing, the ceramic discharge tube and te sealing member are integrally joined to each other, and the current conductor is firmly held through the firing shrinkage of the through-hole of the sealing member. At that time, it is preferable that the diameter of the through-hole after the firing in the state that the current conductor is not inserted through the through-hole of the calcined body for the sealing member is smaller than that of the current conductor before the insertion by 1 to 10%. Further, it is also preferable that the inner diameter of the end portion of the fired ceramic discharge tube in a state that the current conductor is not inserted through the through-hole of the calcined body for the sealing member is smaller than the outer diameter of the fired sealing member by 1 to 10%.

The above final firing is preferably carried out in a reducing atmosphere, and preferably at a temperature of 1700° to 1900° C. In this way, when the reducing atmosphere is employed in the calcining and firing steps, reduction of the second component, such as tungsten, for the sealing member can be prompted, while oxidation thereof is prevented.

In order to form a storing recess at the sealing member, that is, in order to form an inclined surface or a curved surface upon the sealing member, the shape of the pressing mold is modified so that an inclined surface or a curved surface may be formed inside the pressing mold. Further, such an inclined or curved surface can be formed by mechanically working the surface of the molded body or the calcined body for the sealing member.

Further, according to a preferred embodiment of the present invention, the sealing member is composed of an inner portion inserted into the end portion of the ceramic discharge tube and an outer portion integrated with this inner portion and positioned outside the end portion of the discharge tube. The inner portion is made of the same material as that of the ceramic discharge tube, and the outer portion is made of a composition material having a coefficient of thermal expansion between that of the material for the ceramic discharge tube and that of the material for the current conductor. The current conductor is gas-tightly fixed to the outer portion of the sealing member. That is, the current conductor is not gas-tightly fixed to the inner portion of the sealing member. By so doing, the inner portion of the sealing member is integrated with the ceramic discharge tube after the firing, so that the above-mentioned gap is not formed due to the difference in thermal expansion between the inner portion of the sealing member and the current conductor.

The shape of the ceramic discharge tube may be generally tubular, cylindrical, barrel-like or the like, whereas the current conductor is tubular. After an ionizable light-emitting material is sealingly filled in the interior of the discharge tube, the current conductor is sealed by laser welding or electron beam welding.

In the following, the present invention will be explained in more detail with reference to the drawings.

FIG. 1 is a schematic view for illustrating a metal halide high pressure discharge lamp. A ceramic discharge tube 10 is arranged inside an outer tube 2 made of quartz glass or hard glass such that the central axis of the outer tube 2 is aligned with that of the ceramic discharge tube 10. The opposite ends of the outer cylinder 2 are gas-tightly closed with respective caps 3. The ceramic discharge tube 10 includes a barrel-shaped main body 11 with a swelled central portion and end portions 12 at the opposite ends of the main body 11, respectively. The ceramic discharge tube 10 is held by the outer cylinder 2 via two lead wires 1. Each lead wire 1 is connected to the cap 3 via a foil 4. The upper lead wire 1 is welded to a tubular or rod-shaped current conductor 6, whereas the lower lead wire 1 is welded to a tubular current conductor 5.

As mentioned above, each current conductor 5, 6 is passed through a through-hole of each sealing member 8, and fixed thereto. To each current conductor 5, 6 is gas-tightly connected an electrode shaft 7 inside the main body 11 by welding. A coil 9 is wound around the electrode shaft 7. The electrode unit is not limited particularly to the above construction, and for example, an end portion of the electrode shaft 7 is shaped in a spherical form so that this spherical portion may be used as an electrode.

In the case of the metal halide high pressure discharge lamp, an inert gas such as argon and a metal halide are sealingly filled in an inner space 13 of the ceramic discharge tube 10, and mercury is also sealingly filled, if necessary.

Figure 2:
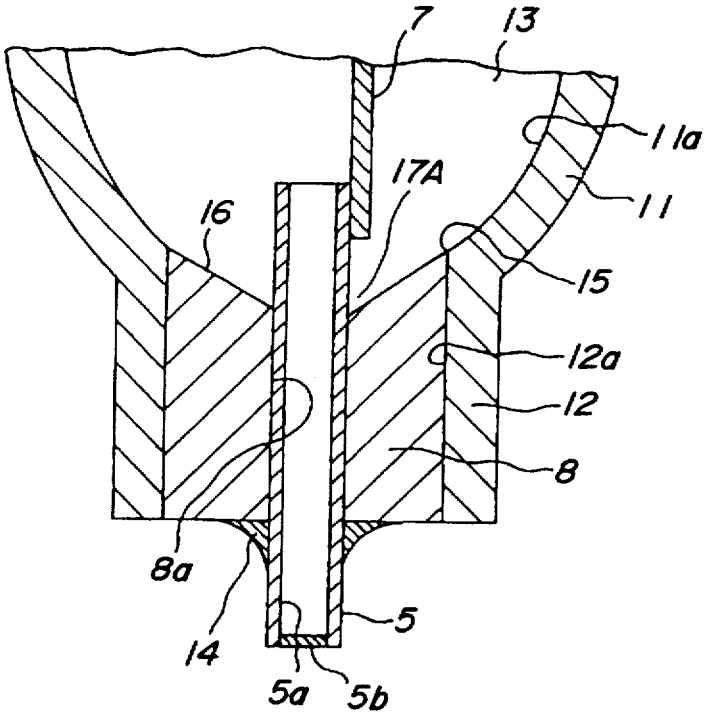
FIG. 2 is an enlarged sectional view illustrating an end structure of a ceramic discharge tube of the high pressure discharge lamp according to the above embodiment of the present invention, in which a storing recess 17A has an almost conical shape.

FIG. 2 is an enlarged sectional view for illustrating a vicinity of the end portion of the ceramic discharge tube shown in FIG. 1. The inner surface 11*a* of the main body 11 is curved, and the inner surface 12*a* of the end portion 12 is straight as viewed in the axial direction of the main body. A corner 15 is formed between the main body 11 and the end portion 12. The sealing member 8 is inserted and held inside the end portion 12. A through-hole 8*a* is formed in the sealing member 8 in the axial direction. A slender, tubular current conductor 5 is inserted through the through-hole 8*a*. A sealing portion 5*b* is fitted to the inner surface 5*a* at the outer end of the current conductor 5. A glass layer 14 is provided at a portion where the current conductor 5 projects form the sealing member 8.

In this embodiment, the current conductor 5 is passed through the through-hole 8*a* of a molded body or a calcined body for the sealing member 8, and an assembly is produced by inserting the resulting molded body or the calcined body into the end portion of a mold body or a calcined body for the ceramic discharge tube. This assembly is integrally fired. At that time, the sealing member 8 is made of a composite material or a cermet in which the same material as that of the ceramic discharge tube 10, preferably alumina is combined with the above-mentioned second component. By so doing, the coefficient of thermal expansion of the sealing member 8 is adjusted to be between that of the material for the ceramic discharge tube and that of the material for the current conductor 5.

The surface of the sealing member 8 on the side of the interior space 13 is designed as an inclined surface 16. An outer edge of the inclined surface 16 is contacted with the corner 15 of the discharge tube such that the inclined surface 16 smoothly continues to the inner surface 11*a* of the main body 11, and no step appears between the main body 11 and the inclined surface 16. In this embodiment, the inclined surface 16 straightly extends from its edge contacting the corner 15 toward the through-hole 8*a* as viewed in section. As a result, a storing recess 17A having an almost conical shape is formed in the sealing member 8 itself on the side of the interior space 13.

A liquid phase of the ionizable light-emitting material flowing to the end of the inner surface 11*a* of the main body 11 instantly goes into the storing recess 17A.

FIGS. 3, 4, 5 and 6 are enlarged sectional views for illustrating vicinities of end portions of ceramic discharge tubes of respective other embodiments of the present invention. In each embodiment, the members already shown in FIG. 2 are denoted by the same reference numerals, and their explanation may be omitted.

Figure 3:
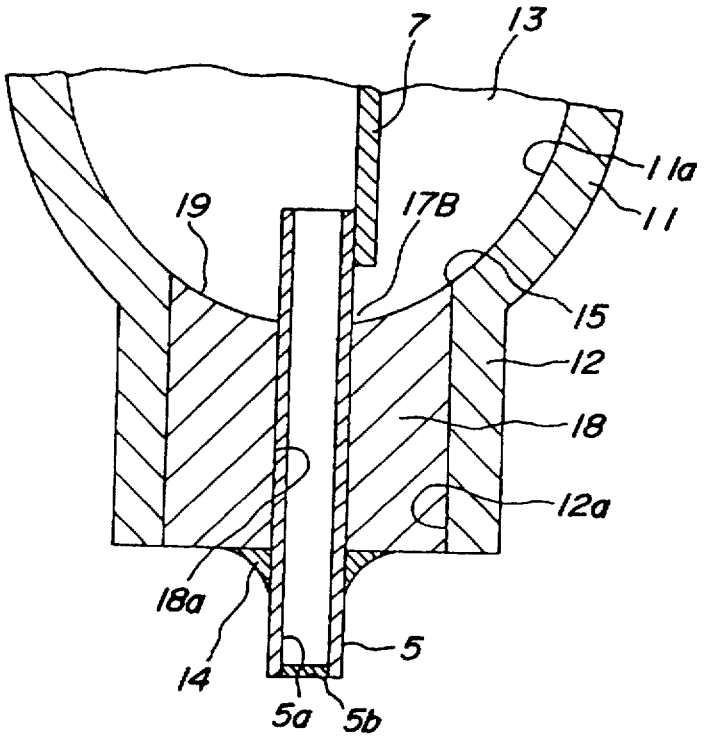
FIG. 3 is an enlarged sectional view illustrating an end structure of a ceramic discharge tube of a high pressure discharge lamp according to another embodiment of the present invention, in which a curved surface 19 is formed at a sealing member 18.

In the embodiment shown in FIG. 3, the surface of the sealing member 18 on the side of the interior space 13 is designed as a curved surface 19. The outer edge of this curved surface 19 contacts the corner 15 of the discharge tube such that the curved surface 19 smoothly continues to the inner surface 11*a* of the main body 11, and the corner 15 does not appear as a step between the main body and the curved surface 19.

In this embodiment, the curved surface 19 has almost the same inclined angle as that of the inner surface 11*a* of the main body 11 near the edge contacting the corner 15, and the inclination angle of the curved surface 19 gradually approaches to the horizon as the location comes near the through hole 18*a*. Consequently, the curved surface becomes horizontal near the through-hole 18*a*. As a result, a storing recess 17B is formed in the storing recess 17B on the side of the interior space 13. A liquid phase of the ionizable light-emitting material flowing to the end of the inner surface 11*a* of the main body 11 instantly goes into the storing recess 17B.

Figure 4:
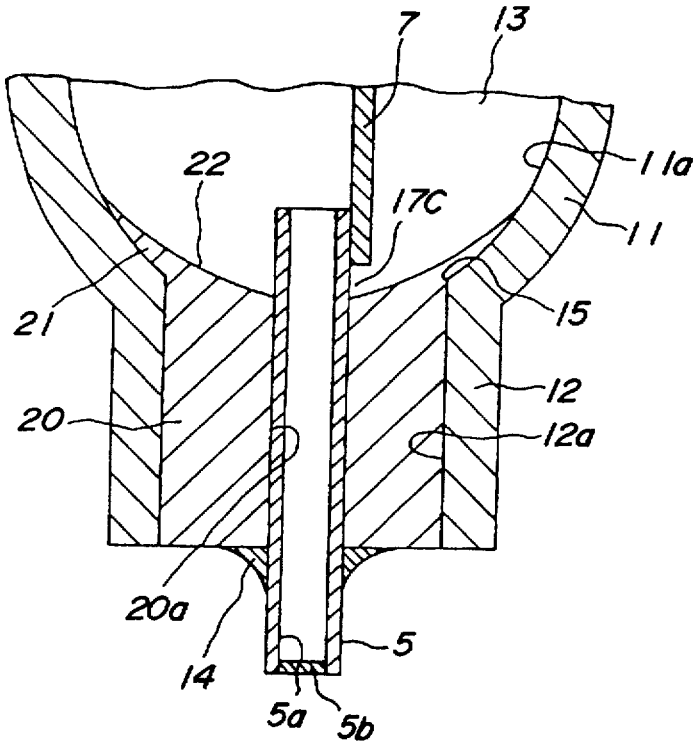
FIG. 4 is an enlarged sectional view of an end structure of a ceramic discharge tube in a further embodiment of the high pressure discharge lamp according to the present invention, a wide covering portion 21 being formed at a sealing member 20 on a side of an interior space 13.

In the embodiment shown in FIG. 4, a sealing member 20 has a cylindrical shape, and an outer peripheral covering portion 21 is provided at an end portion of the cylindrical sealing member 20 on the side of the interior space 13. This covering portion 21 has a shape almost fitting the inner surface 11*a* of the main body, and is designed in the form of a flange extending in a peripheral direction from the edge portion of the cylindrical portion. The corner 15 of the discharge tube and its vicinity are covered with this covering portion 21. The surface of the covering portion 21 on the side of the interior space 13 is designed as a curved surface 22. The outer edge of the curved surface 22 smoothly continues to the inner surface 11*a* of the main body 11.

In this embodiment, the curved surface 22 has almost the same inclination angle as that of the inner surface 11*a* of the main body 11 near the edge portion thereof. As the location approaches the through-hole 20*a*, the inclination angle of the curved surface 22 gradually approaches the horizon. As a result, a storing recess 17C is formed in the sealing member 20 itself on the side of the interior space 13. A liquid phase of the ionizable light-emitting material flowing to the end of the inner surface 11*a* of the main body 11 instantly goes into the storing recess 17B, and does not contact the corner 15 and its vicinity at all.

Figure 5:
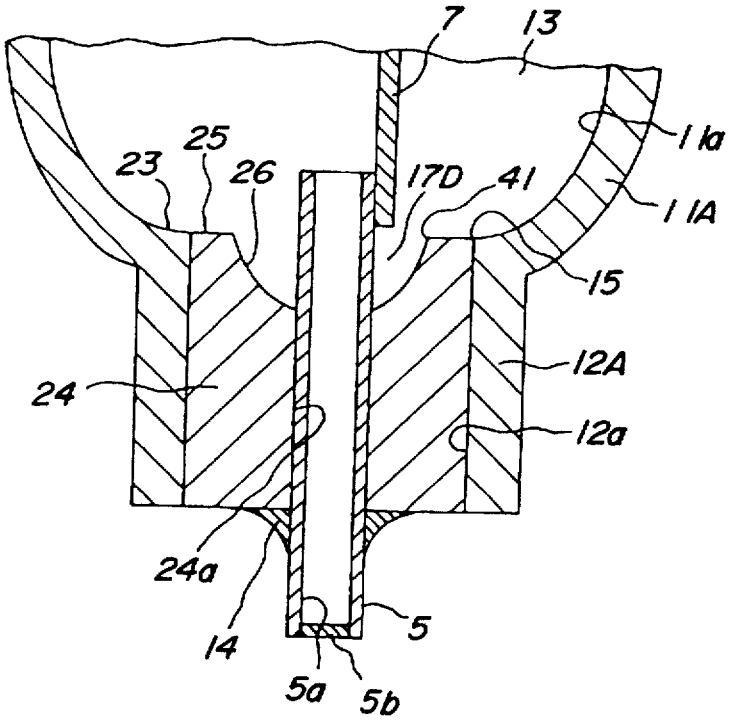
FIG. 5 is an enlarged sectional view of an end structure of a ceramic discharge tube in a further embodiment of the high pressure discharge lamp according to the present invention, a flat or horizontal face 25 and a curved face 26 being formed at a sealing member 23 on a side of an interior space 13.

In the embodiment shown in FIG. 5, the inner surface 11*a* of the main body 11 near the corner of the discharge tube is designed as an almost horizontal surface 23 as illustrated. Therefore, the angle of the corner between the inner surface 11*a* of the main body 11A and the inner surface of the end portion 12A is almost right angle. The surface of the sealing member 24 on the side of the interior space 13 is designed as an outer horizontal surface 25 and an inner curved surface 26. The edge of the horizontal or flat surface 25 contacts the corner 15 of the discharge tube such that the horizontal surface 25 smoothly continues to the horizontal portion 23 of the inner surface 11*a* of the main body 11A, and the corner 15 does not form a step between the main body 11A and the horizontal surface 25.

The curved surface 26 is provided around the through hole 24*a* of the sealing member 24, and continues to the outer peripheral horizontal surface 25. In this embodiment, the curved surface 26 is relatively largely inclined near the horizontal surface 25, and as the location approaches the through hole 24*a*, its inclination angle is decreased to the horizon. As a result, a relatively deep storing recess 17D is formed in the sealing member 24 itself on the side of the interior space 13 and inside the annular horizontal surface 25 as viewed in cross section.

A liquid phase of the ionizable light-emitting material flowing to the end of the inner surface 11*a* of the main body 11A instantly goes into the storing recess 17D. At that time, although a vicinity of the corner 41 is likely to be corroded, this corner is formed at the sealing member 24 itself. Therefore, even if this corner vicinity is corroded, the main body is not adversely affected at all.

Figure 6:
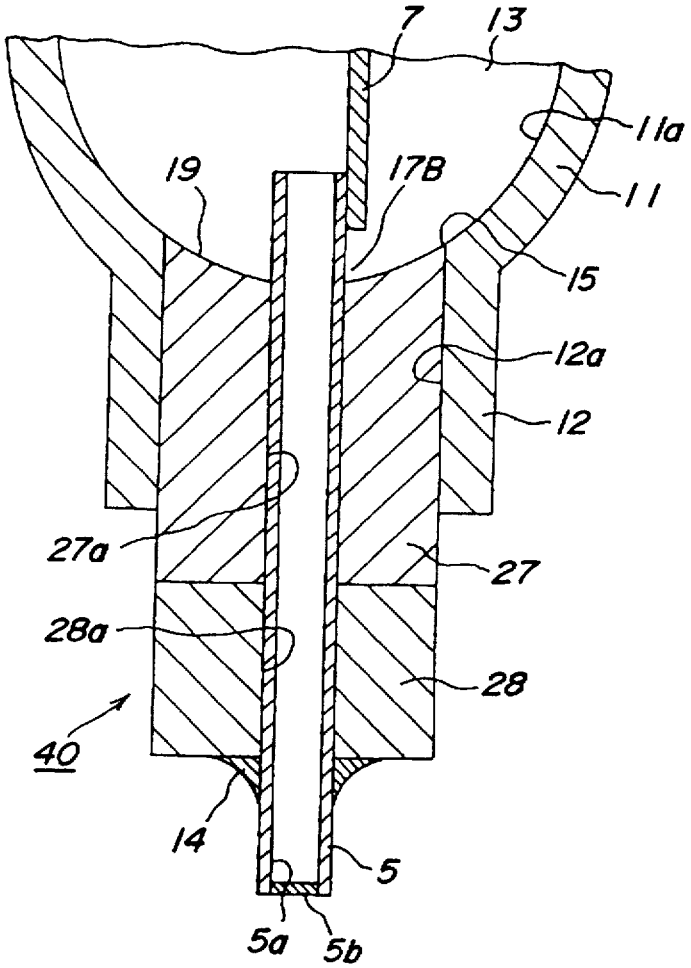
FIG. 6 is an enlarged sectional view of an end structure of a ceramic discharge tube in a further embodiment of the high pressure discharge lamp according to the present invention, a sealing member 40 being constituted by an inner portion 27 and an outer portion 28.

In the embodiment shown in FIG. 6, the sealing member 40 is constituted by an axially inner portion 27 and an axially outer portion 28. The inner portion 27 and the outer portion have been already explained before. The surface of the inner portion 27 on the side of the interior space 13 is designed as a curved surface 19. The outer edge of the curved surface 19 contacts a corner 15 of the discharge tube such that the curved surface 19 smoothly continues to the inner surface 11*a* of the main body 11, and the corner 15 forms no step between the main body 11 and the curved surface 19.

The curved surface 19 has substantially the same inclination angle as that of the inner surface 11*a* near its edge portion contacting the corner 15. As the location approaches the through-hole 27*a* in the inner portion 27, the inclination angle of the curved surface 19 is gradually decreased to the horizon so that the curved surface is almost horizontal near the through-hole 27*a*. As a result, a storing recess 17B is formed at the sealing member 40 itself on the side of the interior space 13. A liquid phase of the ionizable light-emitting material flowing to the end of the inner surface 11*a* of the main body 11 instantly goes into the storing recess 17B.

The outer portion 28 is made of the above-mentioned composite material. The current conductor 5 is inserted through a through-hole 28*a* of the outer portion 28, and the gas-tight sealing is effected there between the current conductor 5 and the outer portion 28. A glass layer 14 is formed around a portion of the current conductor 5 projecting from the outer portion 28.

Figure 7:
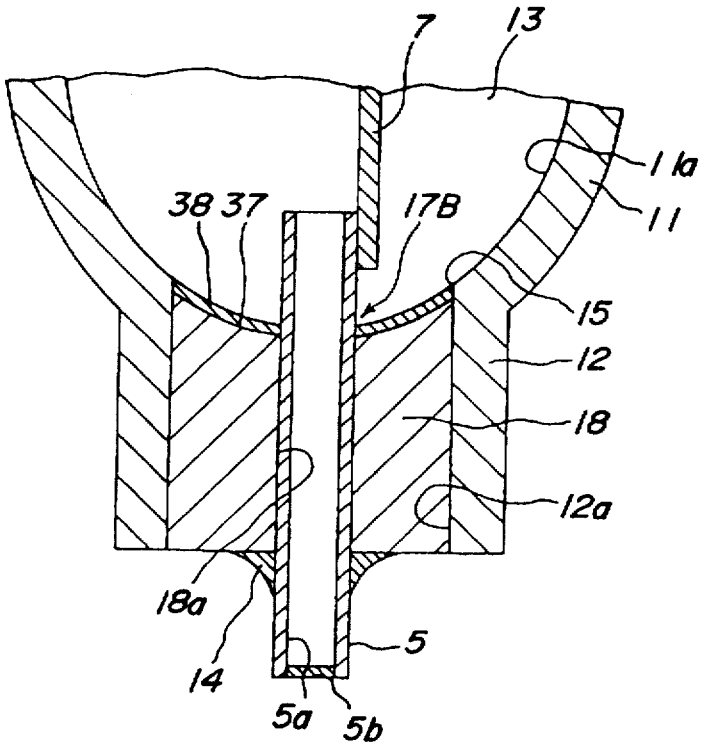
FIG. 7 is an enlarged sectional view of an end structure of a ceramic discharge tube in a still further embodiment of the high pressure discharge lamp according to the present invention, the surface of a sealing member on a side of an interior space being covered with a metal halide-resistant covering film.
Figure 8:
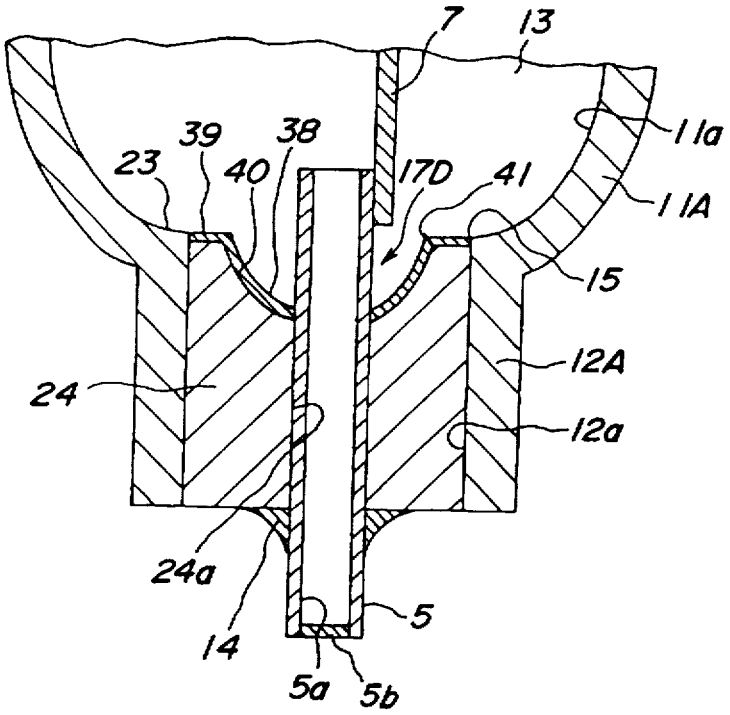
FIG. 8 is an enlarged sectional view of an end structure of a ceramic discharge tube in a still further embodiment of the high pressure discharge lamp according to the present invention.
Figure 9A:
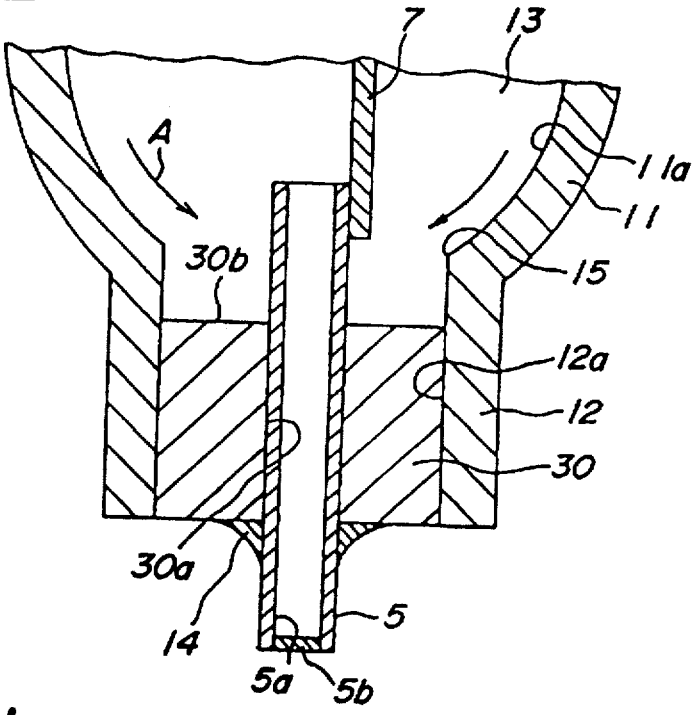
FIG. 9a PRIOR ART
FIG. 9(*a*) is an enlarged sectional view of the end structure of a ceramic discharge pipe in the conventional high pressure discharge lamp, FIG. 9(*b*) being a sectional view for illustrating the state in which a portion of the main body near the corner portion is corroded with a metal halide, etc.
Figure 9B:
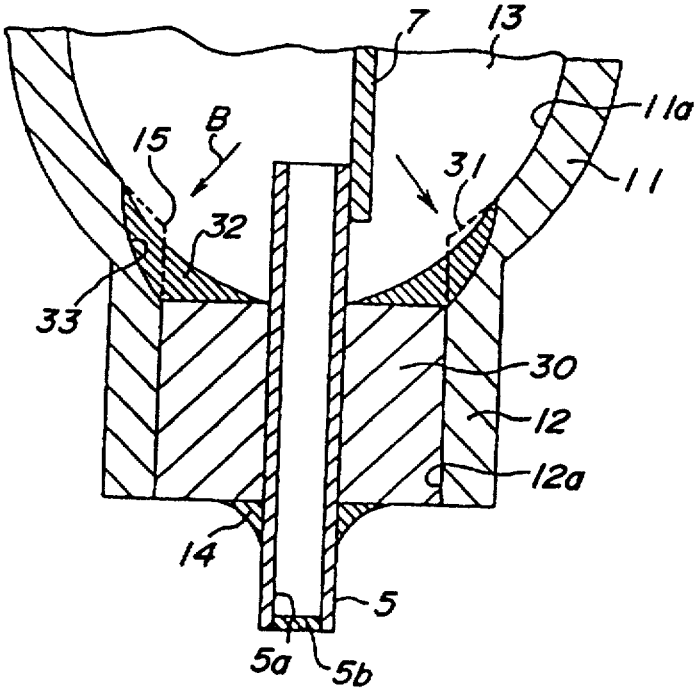
FIG. 9b PRIOR ART
Figure 10:
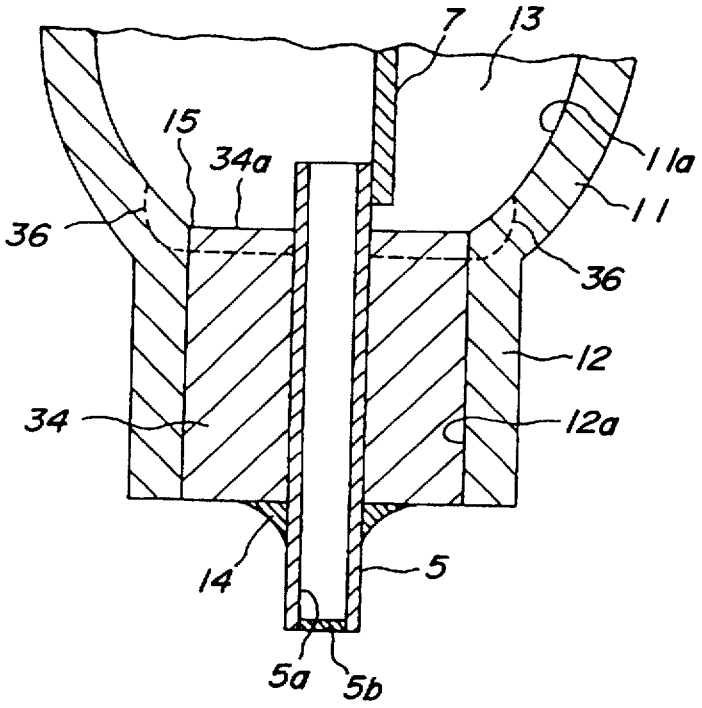
FIG. 10 is a sectional view for illustrating the state in which a portion of a main body in an end structure of a ceramic discharge tube investigated by the inventors is corroded with metal halide.

FIGS. 7 and 8 are enlarged sectional views for illustrating other embodiments of the ceramic discharge tube according to the present invention near end portions thereof, respectively, in which the surface of a sealing member on the side of the interior space is covered with a covering film having resistivity against the metal halide.

In the embodiment shown in FIG. 7, the surface of the sealing member 18 on the side of the interior space 13 is designed as a curved surface 37. In this embodiment, the curved surface 37 has substantially the same inclination angle as that of the inner surface 11 of the main body 11 near the edge portion on the side of the corner 15. As the location approaches the through-hole 18*a* from this edge, the inclination angle of the curved surface 37 is gradually decreased to the horizon so that the curved surface 37 is almost horizontal near the through-hole 18*a*. The covering film is formed over the entire curved surface 37.

The outer edges of the curved surface 37 and the covering film 38 contact the edge portion 15 such that the covering film 38 smoothly continues to the inner surface 11*a* of the main body 11, and the corner 15 does not appear as a step between the main body 11 and the sealing member 18. A liquid phase of the ionizable light-emitting material flowing to the end of the inner surface 11*a* of the main body 11 instantly goes into the storing recess 17B.

In the embodiment shown in FIG. 8, the surface of the sealing member 24 on the side of the interior space 13 is designed as a radially outer horizontal or flat surface 39 and a radially inner curved surface 40 located nearer the through-hole 24*a* than the horizontal surface 39. These surfaces 39 and 40 are smoothly continued at their opposed edges. In this embodiment, as the location approaches the through-hole 24*a* from the contacted edge, the inclination angle of the curved surface 40 is gradually decreased to the horizon. As a result, a relatively deep storing recess 17D is formed at the sealing member 24 on the side of the interior space 13 and radially inside the annular horizontal surface 39 as viewed in a cross section.

A covering film 38 having resistance against the metal halide is formed to cover the horizontal surface 39 and the curved surface 40. The radially outer edge of the covering film 38 contacts the corner 15 of the discharge tube such that the covering film 38 smoothly continues to the horizontal portion 23 of the inner surface 11*a* of the main body 11A, and the corner 15 does not appear as a step between the main body 11A and the sealing member 24.

The covering film having resistance against the metal halide is preferably a metallized layer of a molybdenum-tungsten alloy or a covering film made of yttria ceramic.

As mentioned above, according to the present invention, the high voltage discharge lamp comprises the ceramic discharge lamp having the interior space filled with the ionizable light-emitting material, the sealing member sealing the end portion of the ceramic discharge tube, and the current conductor inserted through the through-hole of the sealing member, wherein the corrosion of the ceramic discharge tube and particularly corrosion in the intermediate area between the main body and the end portion can be prevented to enhance use life of the ceramic discharge tube.

What is claimed is:

1. A high pressure discharge lamp comprising:

a ceramic discharge tube having an interior space filled with an ionizable light-emitting material and a starting gas, said ceramic discharge tube comprising a main body and at least one end portion connected to an end of said main body, a corner being formed between an inner surface of the main body and an inner surface of the at least one end portion;

a sealing member at least partially fixed inside said at least one end portion, said sealing member having an axial bore formed therethrough from an inner axial surface to an outer axial surface thereof, wherein at least a radially central portion of said sealing member has a variable axial thickness that decreases from a point radially distal from said axial bore to a point radially adjacent said axial bore thereby defining a recess for storing substantially all of said ionizable light-emitting material as a liquid phase; and a current conductor inserted through said axial bore of said sealing member.

2. The high pressure discharge tube set forth in claim 1, wherein the inner surface of the main body smoothly continues to the inner axial surface of the sealing member without a step.

3. The high pressure discharge tube set forth in claim 2, wherein a radially outer edge of the inner axial surface of the sealing member contacts the corner.

4. The high pressure discharge tube set forth in claim 1, wherein the inner axial surface of the sealing member is covered with a covering film made of a material having resistance against a metal halide.

5. The high pressure discharge tube set forth in claim 4, wherein a radially outer edge of the covering film smoothly continues to the inner surface of the main body without a step.

6. The high pressure discharge tube set forth in claim 1, wherein a covering portion is formed on the inner axial surface of the sealing member, said covering portion covering said corner, and said storing recess being formed at the covering portion.

7. The high pressure discharge tube set forth in claim 6, wherein the surface of the covering portion is covered with a covering film made of a material having resistance against a metal halide.

8. The high pressure discharge tube set forth in claim 1, wherein said sealing member is made of a composite material having a coefficient of thermal expansion between that of a material constituting the ceramic discharge tube and that of a material constituting the current conductor, and said current conductor is gas-tightly fixed to the sealing member.

9. The high pressure discharge tube set forth in claim 1, wherein said sealing member comprises an axially inner portion inserted inside said end portion of the ceramic discharge tube, and an axially outer portion integrated with the axially inner portion and positioned outside said end portion, said inner portion is made of the same material as that of the ceramic discharge tube, said outer portion is made of a composite material having a coefficient of thermal expansion between that of a material constituting the ceramic discharge tube and that of a material constituting the current conductor, and said current conductor is gas-tightly fixed to the outer portion of the sealing member.

* * * * *